US006725550B1

(12) United States Patent
Shah

(10) Patent No.: US 6,725,550 B1
(45) Date of Patent: Apr. 27, 2004

(54) THREE BLADED PIVOTABLE RAZOR

(76) Inventor: Mrugesh K. Shah, 403 Trails Ct., Houston, TX (US) 77024

( * ) Notice: Subject to any disclaimer, the term of this patent is extended or adjusted under 35 U.S.C. 154(b) by 18 days.

(21) Appl. No.: 10/074,439

(22) Filed: Feb. 13, 2002

(51) Int. Cl.[7] ..... B26B 21/02; B26B 21/52
(52) U.S. Cl. ..... 30/531; 30/50
(58) Field of Search ..... 30/50, 346.57, 30/346.5, 527, 531, 48

(56) References Cited

U.S. PATENT DOCUMENTS 6,311,400 B1 * 11/2001 Hawes et al. ..... 30/527
2002/0088122 A1 * 7/2002 Zuidervaart ..... 30/50

FOREIGN PATENT DOCUMENTS

CA 867029 * 3/1971 ..... 30/346.27

* cited by examiner

*Primary Examiner*—Douglas D. Watts
(74) *Attorney, Agent, or Firm*—Harrison & Egbert

(57) ABSTRACT

A shaver apparatus including a handle, a head connected to the head, a first blade connected to the head and extending transverse to the handle, a second blade connected to the head in parallel relationship to the first blade, and a third blade connected to the head in parallel relationship to the second blade. The third blade extends perpendicular to the head. The first and second blades extend at an acute angle relative a the plane of the head. A spring is connected to each of the blades so as to urge the blades to a desired angle. A spring is also connected to the head and to the handle so as to urge the head to a desired angle with respect to the handle. The head is adjustably angularly connected to the handle.

7 Claims, 2 Drawing Sheets

THREE BLADED PIVOTABLE RAZOR

BACKGROUND OF THE INVENTION

1. Technical Field of the Invention

The present invention relates to razors and razor blades. More particularly, the present invention relates to razors having a pivotable head assembly with respect to the handle. More particularly, the present invention relates to razor assemblies whereby a plurality of blades are connected to the head for close trimming of the beard and facial hair of the user.

2. Description of Related Art

The trimming and shaping of beards, mustaches and side burns is essential for proper grooming and style for the majority of men who wear them. Conventional razors generally include a rectangular razor head mounted on an elongated handle in a fixed transverse relationship to the handle. Conventionally, a straight cutting edge extends from one side or from two opposed sides of the razor heads. The purpose of conventional razors is to remove all or most of the hair from the face. Therefore, the razor head and cutting edges are broad relative to normal facial contours so that the number of shaving strokes required to shave a facial area is reduced. Unfortunately, these conventional razor blades do not effectively closely trim the beard to the surface of the face. As a result, multiple passes of the razor blade over the face are required. This can create cuts and abrasions very frequently. Also, conventional razor blades are not very adaptable to the various contours and shapes of the human face. No technique is provided whereby the angle between the blades and the face can properly accommodate the various inconsistent and irregular facial features.

Among the various types of razor mechanisms known in the art are the channel-type razors which typically have two fixed opposing bars adapted to slidably receive a cartridge having a corresponding fixed track. Such channel-type razors provided support to a cartridge along the entire longitudinal length of the cartridge.

Another type of razor known in the art includes spring actuating engaging members which, upon the application of force to an actuator button, move inwardly or outwardly. After the cartridge has been properly positioned on the razor handle, the actuator button is released allowing the engaging members to return to their non-biased position and thereby engage the cartridge. Such razors have been designed to either maintain the razor cartridge fixed with respect to the razor handle or, are of the "pivoting" type which allow the cartridge to pivot on the razor during shaving. However, such cartridges are often ineffective for proper shaving. The desired angular position of the blade is uncertain in the "pivoting" type blades. Furthermore, there are not a trio of blades for the closer shaving of the face. Multiple passes of the razor are required to shave the face.

Continuing efforts are being made to improve the shaving characteristics of razors and/or to accommodate individual preferences. A factor in shaving efficiency and effectiveness is the orientation of the active components of the shaving system relative to the skin surface being shaved. The surface frequently has undulations or is in a relatively inaccessible or awkward area to reach and the shaving action is reduced in efficiency because the relationship to the active element of the skin surface being shaved significantly departs from the optimum value. Razors in which there is a fixed relationship between the shaving unit and the handle call for considerable dexterity on the part of the user and substantial changes in the disposition of the handle in order to maintain the shaving unit at its optimum attitude on the shaver's face, particularly when negotiating areas, such as the jaw line, where there are gross changes in facial contours.

In the past, various U.S. patents have issued with respect to such "pivotable" razor assemblies. For example, U.S. Pat. No. 4,026,016, issued on May 31, 1977 to W. I. Nissen, describes a razor blade assembly having a blade means disposed between a cap member and a platform member and which is adaptable to be connected to a razor handle. The platform member has journal bearing means for receiving the razor handle mounting means and cam means for receiving a razor handle. The journal bearing means forms a pivot axis for pivotable movement of the razor blade assembly thereabout and the platform cam means is in engagement with a cam follower on the handle and the blade assembly is mounted on the razor handle.

U.S. Pat. No. 4,926,553, issued on May 22, 1990 to Miskin et al, describes a razor for trimming and shaping of beards, moustaches, sideburns and the like. The razor has an elongated handle, a tapered offset neck on one end of the handle and a razor head pivotably attached to the neck by a ball-and-socket joint interposed therebetween. A pivot lock locks the razor head in a desired attitude with respect to the handle and is controllable from the neck of the razor. The razor head carries a blade having opposed arcuate cutting edges, marginal edges of which extend from opposed arcuate surfaces of the razor head.

U.S. Pat. No. 4,094,063, issued on Jun. 13, 1978 to R. A. Trotta, describes a razor assembly including a handle and a shaving unit in which the blade and the guard are permanently fixed together. The handle includes means at one end thereof for pivotably mounting the shaving unit on the handle such that the shaving unit is free to pivot upon the handle during the shaving operation. The handle is a one-piece plastic molding and has means thereon for biasing the pivotably moveable shaving unit toward a central position.

U.S. Pat. No. 4,970,784, issued on Nov. 20, 1990 to Althaus et al, describes a razor having a razor blade unit with a razor blade fixedly disposed in a plastic housing. The razor blade unit is pivotably mounted on the front end of the handle by way of a fork holder that can be opened and closed. The razor blade unit, starting from a spring-loaded neutral position, is pivotable about a pivot axis that extends parallel to the cutting edge of the razor blade. The pivot axis of the forked holder extends in the region of the cutting edge of the razor blade so as to provide the pivot head razor with only slight pivot movements relative to the handle during the shaving process.

U.S. Pat. No. 5,033,152, issued on Jul. 23, 1991 to W. Althaus, describe a wet razor having a handle with a razor blade disposed on the front end of the handle. A turning mechanism is provided whereby the razor blade is freely rotatable relative to the grasping portion of the handle about an axis of rotation that is perpendicular to the cutting edge of the razor blade. A spring-type resetting mechanism automatically returns to a starting position due to spring force.

It is an object of the present invention to provide a razor which includes a head that is spring biased relative to the handle for adjusting to the angular shapes of the face.

It is another object of the present invention to provide a razor whereby the head can be pivotably adjustable with respect to the handle.

It is another object of the present invention to provide a razor having a trio of blades extending parallel to each other for maximum shaving with minimal strokes.

It is another object of the present invention to provide a razor having a single blade extending perpendicular to the head and a pair of blades extending at an acute angle to the head for the purpose of optimizing the closeness of the shave.

It is further object of the present invention to provide a razor whereby the blade elements are resiliently pivotally connected to the head through the use of a spring mechanism.

These and other objects and advantages of the present invention will become apparent from a reading of the attached specification and appended claims.

BRIEF SUMMARY OF THE INVENTION

The present invention is a shaver apparatus comprising a handle having a longitudinal axis, a head connected to the handle, a first blade connected to the head and extending transverse to the longitudinal axis of the handle, a second blade connected to the head in parallel relationship to the first blade and a third blade connected to the head in parallel relationship to the second blade. The third blade extends perpendicular to the head. The third blade is at a different angle with respect to the head than the first and second blades.

In the present invention, the head is pivotally connected to the handle such that the relative angle between the head and the handle is adjustable. A spring means is connected to the head for resiliently urging the head to a desired angle with respect to the handle. The spring means is a leaf spring having one arm connected to the head and another arm connected to the handle. A gear element is connected to the head for allowing the manual rotating of the head so as to have a desired angle with respect to the handle.

Each of the first and second blades extends at a plane that is at an acute angle relative to the head. Each of the first and second blades is at a similar acute angle. Each of the first, second and third blades is pivotably connected to the head. A spring means is connected to each of these blades for maintaining these blades at a desired angle with respect to the head. This spring is a leaf spring having one arm connected to the respective blade and another arm connected to the head.

DETAILED DESCRIPTION OF THE INVENTION

Figure 1:
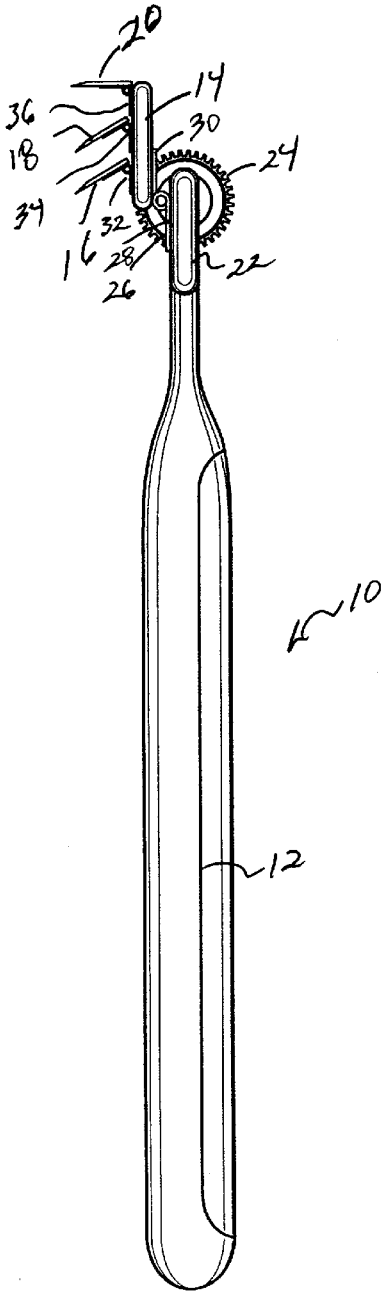
FIG. 1 is a side elevational view of the razor in accordance with the teachings of the present invention.

Referring to FIG. 1, there is shown the shaver apparatus 10 in accordance with the teachings of the present invention. The shaver apparatus 10 includes a handle 12, a head 14 connected to the handle 12, a first blade 16 connected to the head and extending transverse to the longitudinal axis of the handle 12, a second blade 18 connected to the head in parallel relationship to the first blade 16 and a third blade 20 connected to the head 14 in parallel relationship to the second blade 18. As can be seen in FIG. 1, the third blade 20 is arranged at a different angle than the first blade 16 or the second blade 18.

In the present invention, the handle 12 can be in the form of a conventional handle having a suitable shape for grasping. The handle 12 has a longitudinal axis extending therealong from the bottom to the top of the handle 12. The handle 12 includes an upper portion 22 which can support a pivot axis and ratchet member 24 thereon. The ratchet member 24 allows the head 14 to be manually rotated so as to assume a desired angle with respect to the longitudinal axis of the handle 12. In FIG. 1, a gear-type member 24 is particularly illustrated as being the ratchet member. However, it is to be noted that various other types of adjusting mechanisms can be employed within the scope of the present invention. The gear-type ratchet mechanism is merely one type of mechanism that can allow for the angular adjusting of the head 14 with respect to the handle 12. In FIG. 1, it can be seen that a leaf spring 26 has arm 28 connected to the upper portion 22 of the handle 12. Another arm 30 is connected to the head 14. Leaf spring 26 allows for a resilient connection between the head 14 and the handle 12 for the purposes of smoother shaving. For example, when the razor 10 encounters rougher uneven surfaces on the face, the head 14 can spring or resiliently move relative to the handle 12 so as to accommodate such facial irregularities.

In FIG. 1, it can be seen that the first blade 16 and the second blade 18 are pivotably connected to the head 14. The blades 16 and 18 extend outwardly, at an acute angle, relative to the plane of the head 14. The acute angle of the blades 16 and 18 with respect to the head 14 is identical relative to the separate blades 16 and 18.

In order to allow for accommodation of facial irregularities, a certain amount of resilience is provided to the blades 16 and 18 through the use of spring mechanisms 32 and 34 associated with the respective blades 16 and 18. Spring mechanisms 32 and 34 are leaf springs that have one arm connected to the respective blades 16 and 18 and another arm connected to the head 14. As such, the springs 32 and 34 will urge the respective blades 16 and 18 to a desired angular orientation with respect to the head 14. Similarly, another spring 36 is provided in association with the third blade 20. This third spring 36 also establishes a resilient orientation between the third blade 20 and the head 14. Because of the resilient nature of respective springs 32, 34 and 36, a small amount of resilient movement is provided to the respective blades 16, 18 and 20 during shaving. The springs 32, 34 and 36 also serve to limit the amount of pivotal movement of the respective blades 16, 18 and 20.

Figure 2:
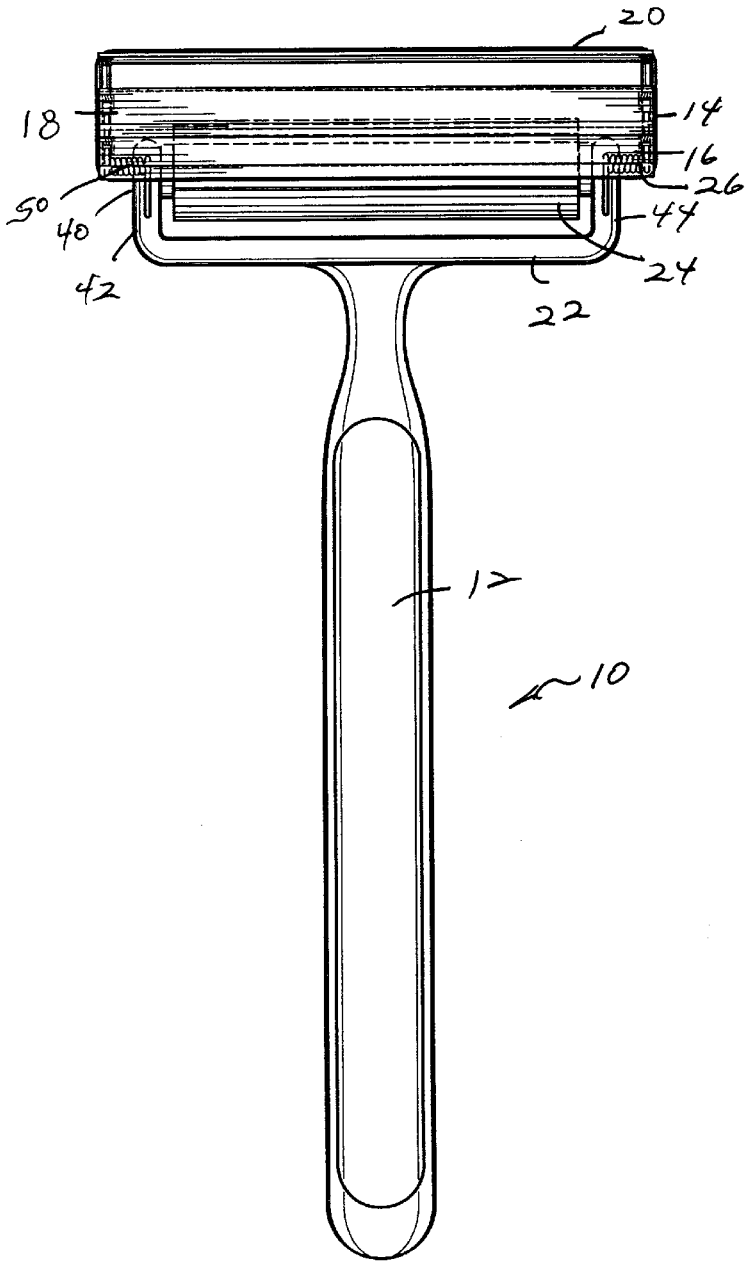
FIG. 2 is a frontal view of the razor in accordance with the preferred embodiment of the present invention.

FIG. 2 shows another view of the razor 10 of the present invention. In FIG. 2, the handle 12 has a U-shaped upper portion 22 suitable for supporting the ratchet member 24 along a pivot axis 40 extending between the arms 42 and 44 of the U-shaped upper portion 22. The head 14 is illustrated as located behind the respective blades 16, 18 and 20. As can be seen in FIG. 2, the third blade 20 extends outwardly perpendicular to the head 14. The blades 16 and 18 extend at an acute angle relative to the plane of the head 14. In FIG. 2, the leaf spring 26 is particularly illustrated. Separate leaf springs 26 and 50 are affixed to the arms 42 and 44 of the handle 12.

Figure 3:
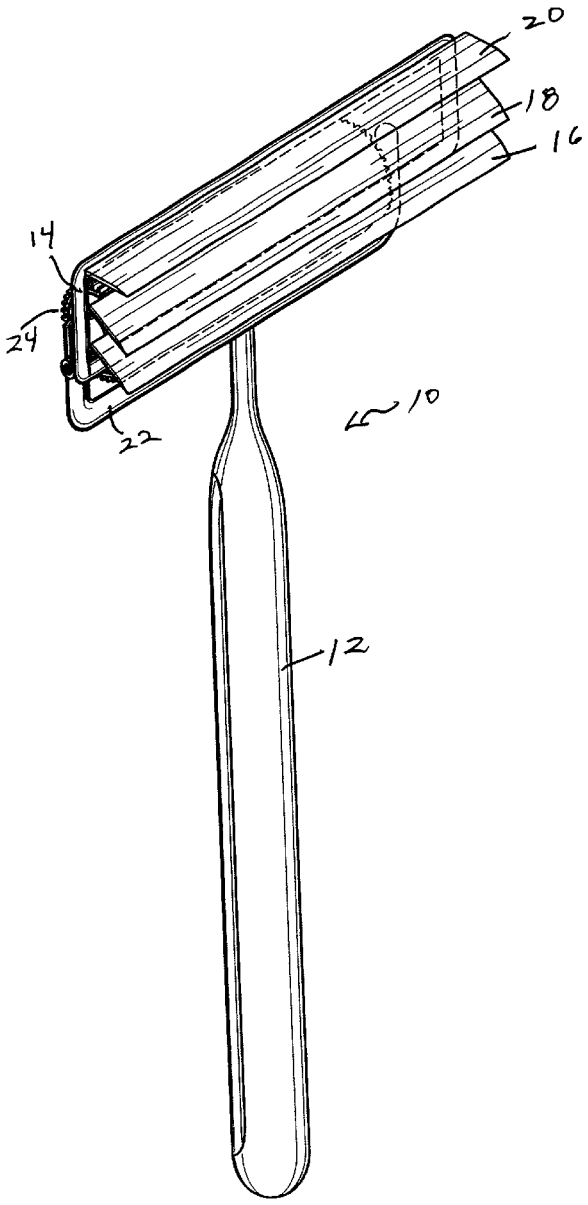
FIG. 3 is a perspective view of the razor in accordance with the teachings of the present invention.

FIG. 3 shows a further perspective view of the shaver apparatus 10 of the present invention. In FIG. 3, the handle 12 extends upwardly to the U-shaped upper portion 22. The blades 16 and 18 extend outwardly from the head 14 at an acute angle. The third blade 20 extends outwardly transverse to the head 14. The ratchet member 24 is located behind the head 14 for the purposes of pivoting the head 14 relative to the handle 12.

Figure 4:
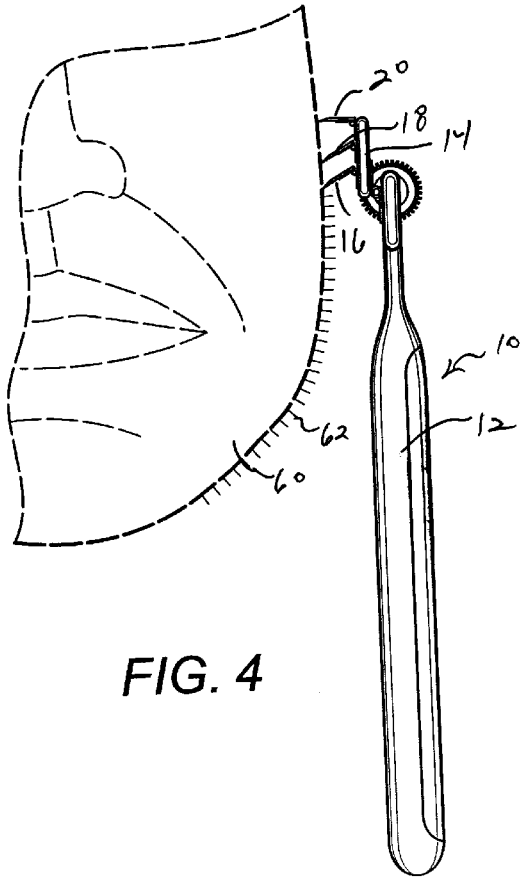
FIG. 4 is an operational diagram showing the use of the razor of the present invention on the beard of a user.

FIG. 4 shows the operation of the shaver apparatus 10 of the present invention as applied to a human face 60. In FIG. 4, the human face 60 includes a beard 62. The handle 12 is in a suitable position for grasping by a human hand. The blades 16, 18 and 20 are shown in a position such that the outer edges of the respective blades 16, 18 and 20 contact the face. As can be seen, as the handle 12 is moved downwardly, the first blade 16 will be the first blade to encounter the beard 62. This will cause the beard to be pulled outwardly and certain hairs of the beard to be cut. The second blade 18 will follow the path of the first blade 16 so as to further shear the hair from the beard 62. Finally, the transverse blade 20 provides a final follow-up cut so as to deeply remove the hair follicles from the face. Since the third blade 20 extends out transversely to the head 14, the third blade 20 extends a further distance from the head 14 than the first and second blades. As such, the third blade 20 will provide a closer cut for better beard removal than the first blade 16 and second blade 18.

The arrangement of blades of the present invention assures an optimal shaving of the beard 62. Furthermore, the use of the trio of blades will minimize the number of blade strokes that are required for the trimming of the beard 62. This arrangement of blades 16, 18 and 20 assures that the hair follicles are trimmed to their deepest point in the face. The resilient connection between the blades and the head 14 will allow for any inconsistency in beard density or facial contours. Similarly, the ability to adjust angularly the relationship of the head 14 to the handle 12 will allow the user to adapt the razor for comfortable and convenient use. The resilient connection between the head 14 and the handle 12 will allow for adaptability for unusual or unexpected facial contours.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A shaver apparatus comprising:

a handle having a longitudinal axis;

a head connected to said handle, a first blade connected to said head and extending transverse to said longitudinal axis of said handle, said head being pivotably connected to said handle such that a relative angle between said head and said handle is adjustable;

a second blade connected to said head in parallel relationship to said first blade;

a third blade connected to said head in parallel relationship to said second blade, said third blade extending perpendicular to said head, said third blade being at a different angle with respect to said head than said first and second blades; and a spring means connected to said head for resiliently urging said head to a desired angle with respect to said handle.

2. The apparatus of claim 1, said spring means comprising a leaf spring having one arm connected to said head and another arm connected to said handle.

3. A shaver apparatus comprising:

a handle having a longitudinal axis;

a head connected to said handle, a first blade connected to said head and extending transverse to said longitudinal axis of said handle, said head being pivotably connected to said handle such that a relative angle between said head and said handle is adjustable;

a second blade connected to said head in parallel relationship to said first blade;

a third blade connected to said head in parallel relationship to said second blade, said third blade extending perpendicular to said head, said third blade being at a different angle with respect to said head than said first and second blades; and a gear means connected to said head for fixing a desired angle between said handle and said head.

4. A shaver apparatus comprising:

a handle having a longitudinal axis;

a head connected to said handle, a first blade connected to said head and extending transverse to said longitudinal axis of said handle, a second blade connected to said head in parallel relationship to said first blade;

a third blade connected to said head in parallel relationship to said second blade, said third blade extending perpendicular to said head, said third blade being at a different angle with respect to said head than said first and second blades, each of said first and second blades extending in a plane that is at an acute angle with respect to said head, each of said first and second blades being at a similar acute angle.

5. A shaver apparatus comprising:

a handle having a longitudinal axis;

a head connected to said handle, a first blade connected to said head and extending transverse to said longitudinal axis of said handle, a second blade connected to said head in parallel relationship to said first blade;

a third blade connected to said head in parallel relationship to said second blade, said third blade extending perpendicular to said head, said third blade being at a different angle with respect to said head than said first and second blades, each of said first, second and third blades being pivotably connected to said head.

6. The apparatus of claim 5, each of said first, second and third blades having a spring means connected thereto, said spring means for maintaining said first blade and said second blade and said third blade at a desired angle with respect to said head.

7. The apparatus of claim 6, said spring means being leaf springs respectively connected to said first blade and said second blade and said third blade.

* * * * *